US005449323A

United States Patent [19]

Melton

[11] Patent Number: 5,449,323

[45] Date of Patent: Sep. 12, 1995

[54] MULTI-AXIS SWING

[76] Inventor: Randy Melton, 12304 NW. Barnes Rd., Portland, Oreg. 97229

[21] Appl. No.: 216,349

[22] Filed: Mar. 23, 1994

[51] Int. Cl.[6] ..... A63G 9/00

[52] U.S. Cl. ..... 472/118; 472/119; 472/121; 434/55

[58] Field of Search ..... 472/118, 119, 121, 122, 472/123, 47, 46, 17, 31, 32, 33, 20; 482/69, 143, 144; 434/55

[56] References Cited

U.S. PATENT DOCUMENTS 1,393,456 10/1921 Ruggles ..... 434/55 X
4,036,489 7/1977 Potyondy ..... 472/118 X
4,402,500 9/1983 Coles ..... 434/35 X
4,978,120 12/1990 Greenwood ..... 472/118 X

*Primary Examiner*—Carl D. Friedman
*Assistant Examiner*—Kien T. Nguyen
*Attorney, Agent, or Firm*—Michael I. Kroll

[57] ABSTRACT

A multi-axis swing is provided, which consists of a seat that is sat upon by a person. A structure is for suspending the seat from above, so that the person may swing back and forth in an arc. A first mechanism operable by the person in the seat is for performing backward and forward somersault rolls. A pair second mechanism operable by the person in the seat is for performing left and right barrel rolls.

8 Claims, 2 Drawing Sheets

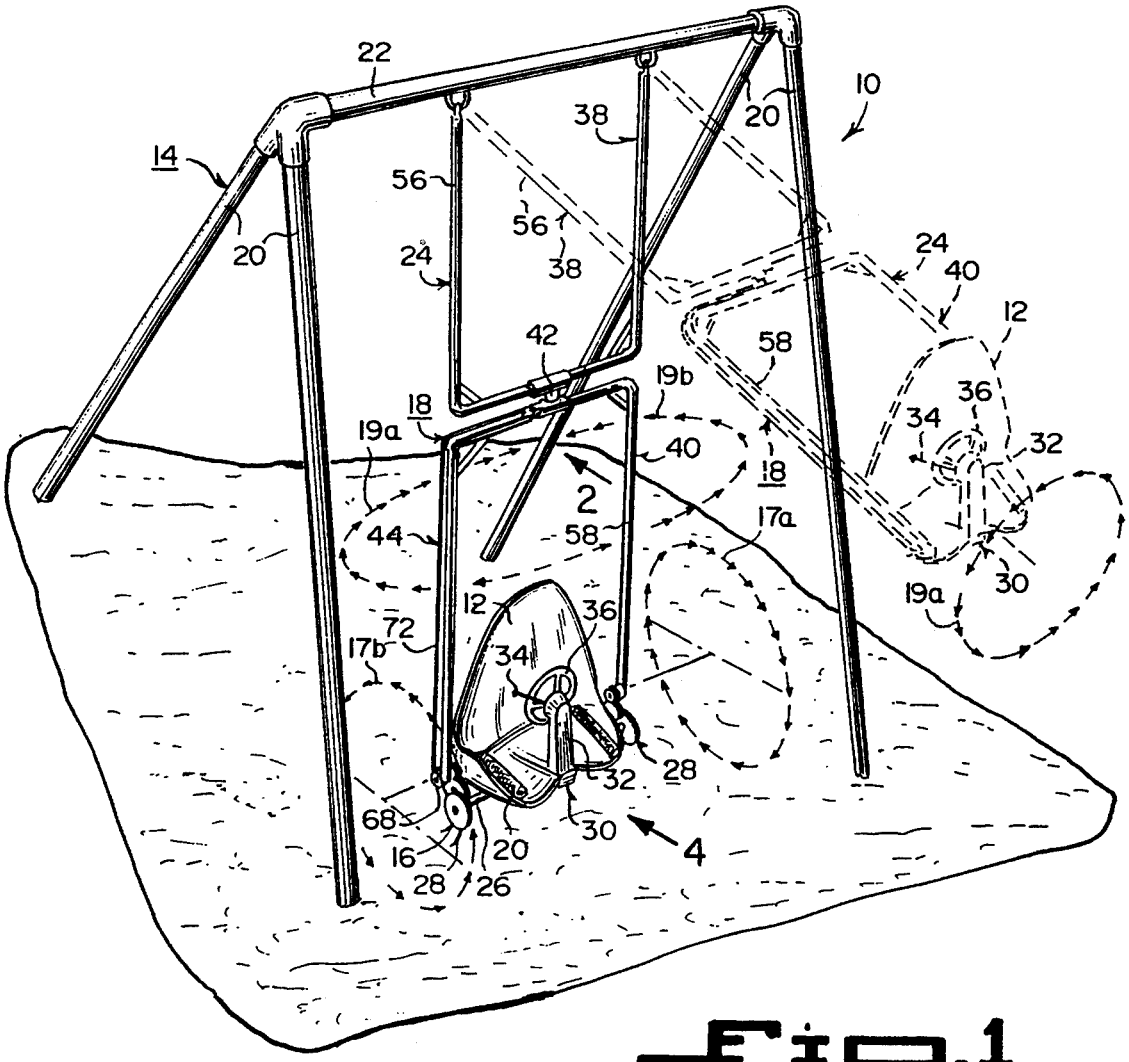
Fig. 1
Fig. 2
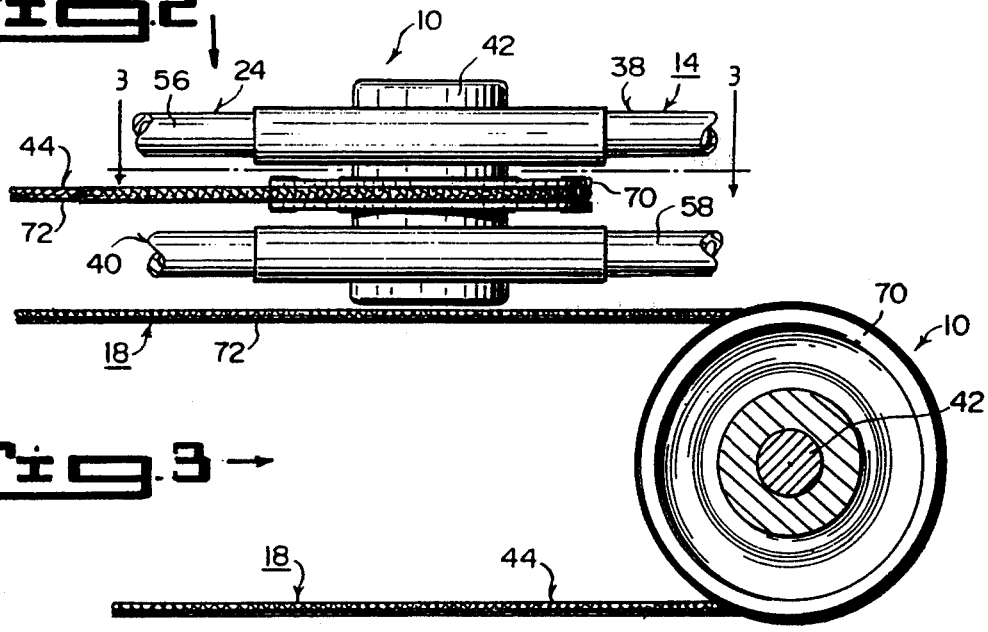
Fig. 3

MULTI-AXIS SWING

BACKGROUND OF THE INVENTION

1. Field of the Invention

The instant invention relates generally to backyard swing equipment and more specifically it relates to a multi-axis swing.

2. Description of the Prior Art

Numerous backyard swing equipment have been provided in prior art that are adapted to suspend seats from above, on which persons may swing back and forth in areas for recreation. While these units may be suitable for the particular purpose to which they address, they would not be as suitable for the purposes of the present invention as heretofore described.

SUMMARY OF THE INVENTION

A primary object of the present invention is to provide a multi-axis swing that will overcome the shortcomings of the prior art devices.

Another object is to provide a multi-axis swing in which a person strapped into a seat may perform backward and forward somersault rolls by operating a gearshift lever and a joystick control on the seat, while swinging back and forth in an arc or sitting still.

An additional object is to provide a multi-axis swing in which the person strapped into the seat may perform left and right barrel rolls by turning a steering wheel on the joystick control, while swinging back and forth in the arc or sitting still.

A further object is to provide a multi-axis swing that is simple and easy to use.

A still further object is to provide a multi-axis swing that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of the instant invention in use.

FIG. 2 is an enlarged front view of a portion thereof taken in the direction of arrow 2 in FIG. 1.

FIG. 3 is a cross sectional view taken along line 3—3 in FIG. 2.

DETAILED DESCRIPTION OF THE PREFERRED EMBODIMENTS

Figure 4:
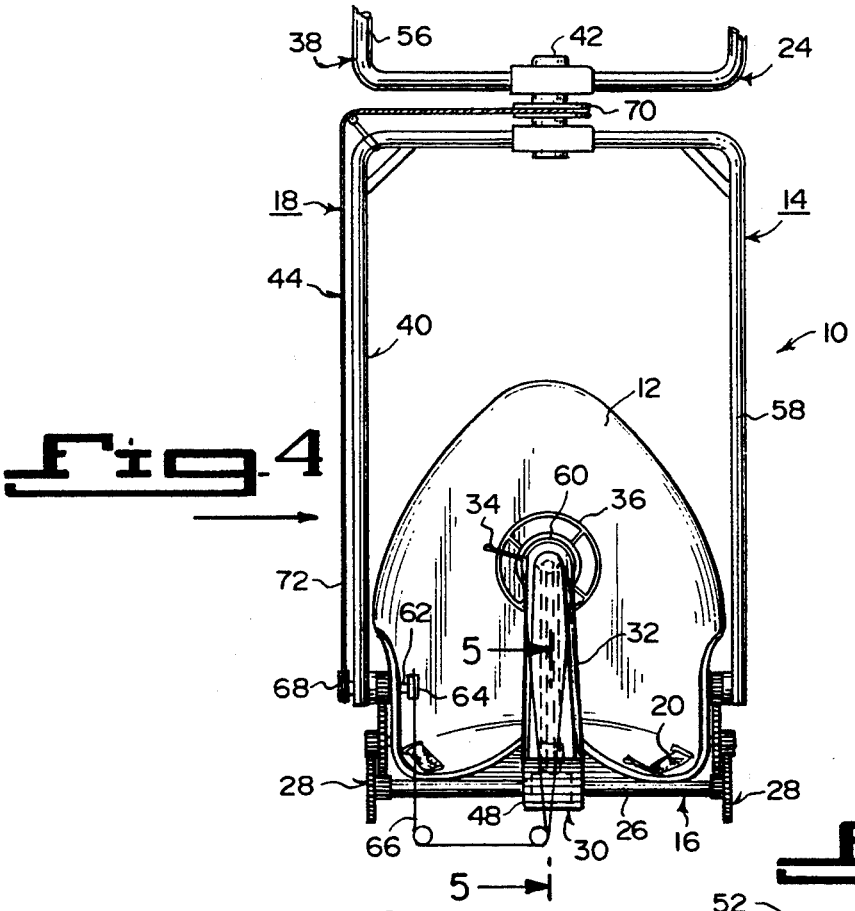
FIG. 4 is a diagrammatic front view of a portion of the instant invention taken in the direction of arrow 4 in FIG. 1.

Turning now descriptively to the drawings, in which similar reference characters denote similar elements throughout the several views, FIGS. 1 through 7 illustrate a multi-axis swing 10, which consists of a seat 12 that is sat upon by a person. A structure 14 is for suspending the seat 12 from above, so that the person may swing back and forth in an arc. A first mechanism 16 operable by the person in the seat 12, is for performing backward and forward somersault rolls **17*a* and 17*b*. A second mechanism 18 operable by the person in the seat 12, is for performing left and right barrel rolls 19*a* and 19*b***.

A belt 20 is located on the seat 12, so that the person will be strapped into the seat to prevent the person from accidentally falling out of the seat 12. The seat suspending structure 14 includes two pair of spaced apart V-positioned legs 20. A top rail 22 extends between the two pair of legs 20. A framework assembly 24 extends upwardly from the seat 12 and is hinged to the top rail 22.

The first performing mechanism 16 consists of an axle 26 under the seat 12. A pair of gear assemblies 28 are provided, with each mounted at opposite ends of the axle 26 and at opposite sides of the seat 12. A transmission assembly 30 is at the center of the axle 26. A joystick 32 extends upwardly from the transmission assembly 30 in the front center of the seat 12. A gearshift lever 34 is on the joystick 32. The person sitting in the seat 12 can operate the gearshift lever 34, to disengage the transmission assembly 30 and pull the joystick 32 backward to cause the backward somersault roll of the seat 12 and push the joystick 32 forward, to cause the forward somersault roll of the seat 12.

The second performing mechanism 18 contains a steering wheel 36 rotatively connected to the joystick 32. The framework 24 is divided into two segments 38 and 40. A bearing 42 is for pivotally mounting the lower segment 40 to the upper segment 38. A swivel assembly 44 extends between the steering wheel 36 and the bearing 42. The person sitting in the seat 12 can turn the steering wheel 36, to cause the right and left barrel roll of the lower segment 40 of the framework 24 with the seat 12.

Figure 5:
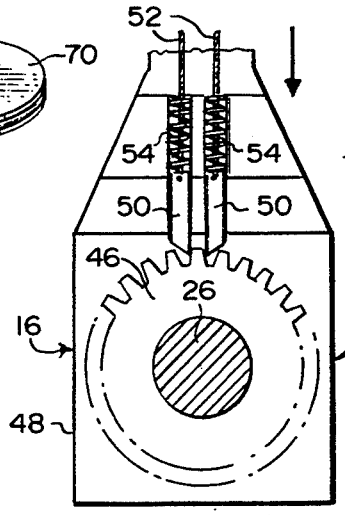
FIG. 5 is a diagrammatic cross sectional view taken along line 5—5 in FIG. 4.
Figure 6:
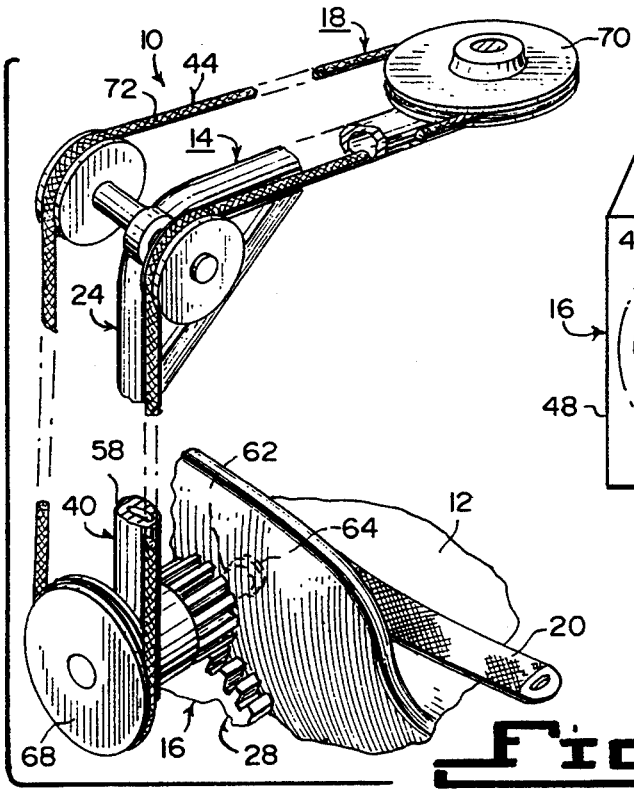
FIG. 6 is an enlarged front perspective view of a portion of the instant invention.
Figure 7:
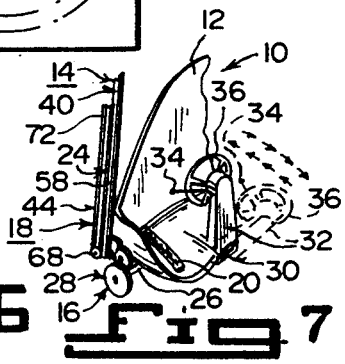
FIG. 7 is a front perspective view of a portion of the instant invention showing operation of the joystick for forward and backward rolls.

The transmission assembly 30, as best seen in FIG. 5, includes a gear 46 affixed to the center of the axle 26. A housing 48 at a bottom end of the joystick 32 extends about the gear 46. A pair of shift dogs 50 are slideably carried in the housing 48 above the gear 46. A pair of cables 52 extend from the shift dogs 50 to the shift lever 34. A pair of springs 54 are to bias the shift dogs 50, to normally engage with the gear 46 in a locked condition.

The upper segment 38 of the framework assembly 24 is a first U-shaped tube 56 hinged at its top ends to the top rail 22. The lower segment 40 of the framework assembly 24 is a second U-shaped tube 58 inverted. The bottom center of the first U-shaped tube 56 and the top center of the second U-shaped tube 58 are pivotally mounted together by the bearing 42.

The swivel assembly 44 includes a first pulley 60 mounted to the steering wheel 36. A shaft 62 is rotatively mounted through one side of the seat 12. A second pulley 64 is mounted to an inner end of the shaft 62. A first continuous belt 66, as shown diagrammatically in FIG. 4, extends between the first pulley 60 and the second pulley 64, so that when the steering wheel 36 is turned the shaft 62 will rotate.

A third pulley 68 is mounted to an outer end of the shaft 62. A fourth pulley 70 is mounted to the bearing 42 between the first U-shaped tube 56 and the second U-shaped tube 58. A second continuous belt 72 extends between the third pulley 68 and the fourth pulley 70. When the steering wheel 36 is turned the bearing 42 will pivot, causing the second U-shaped tube 58 to swivel thereabout.

LIST OF REFERENCE NUMBERS

10 multi-axis swing
12 seat
14 seat suspending structure
16 first performing mechanism
17*a* backward somersault roll
17*b* forward somersault roll
18 second performing mechanism
19*a* a left barrel roll
19*b* right barrel roll
20 leg
22 top rail
24 framework assembly
26 axle
28 gear assembly
30 transmission assembly
32 joystick
34 gearshift lever
36 steering wheel
38 upper segment
40 lower segment
42 bearing
44 swivel assembly
46 gear
48 housing
50 shift dog
52 cable
54 spring
56 first U-shaped tube for 38
58 second U-shaped tube for 40
60 first pulley
62 shaft
64 second pulley
66 first continuous belt
68 third pulley
70 fourth pulley
72 second continuous belt It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed and desired to be protected by Letters Patent is set forth in the appended claims:

1. A multi-axis swing which comprises:

a) a seat that is sat upon by a person;

b) means for suspending said seat from above, so that the person may swing back and forth in an arc, said seat suspending means including two pair of spaced apart V-positioned legs, a top rail extending between said two pair of legs, and a framework assembly extending upwardly from said seat and hinged to said top rail, said framework divided into upper and lower segments;

c) first performing means operable by the person in said seat, for performing backward and forward somersault rolls;

d) second performing means operable by the person in said seat, for performing left and right barrel rolls; and e) a belt located on said seat, so that the person will be strapped into said seat to prevent the person from accidentally falling out of said seat.

2. A multi-axis swing as recited in claim 1, wherein said first performing means includes:

a) an axle under said seat;

b) a pair of gear assemblies, each mounted at opposite ends of said axle and at opposite sides of said seat;

c) a transmission assembly at the center of said axle;

d) a joystick extending upwardly from said transmission assembly in the front center of said seat; and e) a gearshift lever on said joystick, so that the person sitting in said seat can operate said gearshift lever to disengage said transmission assembly and pull said joystick backward, to cause the backward somersault roll of said seat and push said joystick forward, to cause the forward somersault roll of said seat.

3. A multi-axis swing as recited in claim 2, wherein said second performing means includes:

a) a steering wheel rotatively connected to said joystick;

b) said bearing for pivotally mounting a lower segment to an upper segment; and c) a swivel assembly extending between said steering wheel and said bearing, so that the person sitting in said seat can turn said steering wheel to cause the right and left barrel roll of said lower segment of said framework with said seat.

4. A multi-axis swing as recited in claim 3, wherein said transmission assembly includes:

a) a gear affixed to the center of said axle;

b) a housing at a bottom end of said joystick to extend about said gear;

c) a pair of shift dogs slideably carried in said housing above said gear;

d) a pair of cables extending from said shift dogs to said shift lever; and e) a pair of springs to bias said shift dogs to normally engage with said gear in a locked condition.

5. A multi-axis swing as recited in claim 4, wherein an upper segment of said framework assembly is a first U-shaped tube hinge at its top ends to said top rail.

6. A multi-axis swing as recited in claim 5, wherein an lower segment of said framework assembly is a second U-shaped tube inverted, in which the bottom center of said first U-shaped tube and the top center of said second U-shaped tube are pivotally mounted together by said bearing.

7. A multi-axis swing as recited in claim 6, wherein said swivel assembly includes:

a) a first pulley mounted to said steering wheel;

b) a shaft rotatively mounted through one side of said seat;

c) a second pulley mounted to an inner end of said shaft; and d) a first continuous belt extending between said first pulley and said second pulley, so that when said steering wheel is turned said shaft will rotate.

8. A multi-axis swing as recited in claim 7, wherein said swivel assembly further includes:

a) a third pulley mounted to an outer end of said shaft;

b) a fourth pulley mounted to said bearing between said first U-shaped tube and said second U-shaped tube; and c) a second continuous belt extending between said third pulley and said fourth pulley, so that when said steering wheel is turned said bearing will pivot causing said second U-shaped tube to swivel thereabout.

* * * * *